US005559761A

United States Patent [19]

Frenkel et al.

[11] Patent Number: 5,559,761

[45] Date of Patent: Sep. 24, 1996

[54] WATCH WITH TIME INFORMATION VIA SILENT VIBRATION

[75] Inventors: Erik J. Frenkel, Neuchâtel; Jean-Jacques Born, Morges, both of Switzerland

[73] Assignee: Asulab S.A., Bienne, Switzerland

[21] Appl. No.: 556,838

[22] Filed: Nov. 2, 1995

[30] Foreign Application Priority Data

Nov. 3, 1994 [CH] Switzerland ..... 03281/94

[51] Int. Cl.[6] ..... G04C 17/00; G04B 23/02; G04B 21/02

[52] U.S. Cl. ..... 368/69; 368/74; 368/187; 368/230

[58] Field of Search ..... 368/69, 71, 72, 368/75, 185, 187, 230; 340/384 E, 407

[56] References Cited

U.S. PATENT DOCUMENTS

| | | | |
|---|---|---|---|
| 3,938,317 | 2/1976 | Spano | 58/23 R |
| 4,055,843 | 10/1977 | Whitaker | 340/384 E |
| 4,334,280 | 6/1982 | McDonald | 364/710 |
| 4,472,065 | 9/1984 | Goodman | 368/71 |
| 5,365,497 | 11/1994 | Born | 368/230 |

FOREIGN PATENT DOCUMENTS

| | | |
|---|---|---|
| 0198576 | 10/1986 | European Pat. Off. . |
| 0349230 | 1/1990 | European Pat. Off. . |
| 7435930 | 10/1974 | Germany . |
| 2714585 | 3/1978 | Germany . |
| 8700364 | 1/1987 | Germany . |
| 3803387 | 8/1989 | Germany . |
| 61-28957 | 2/1986 | Japan . |
| 618827 | 8/1980 | Switzerland . |

*Primary Examiner*—Vit W. Miska

*Attorney, Agent, or Firm*—Grifin, Butler, Whisenhunt & Kurtossy

[57] ABSTRACT

An electronic timepiece having an analog or digital display delivering time information in silent, tactile manner in which the control elements (L, C, $B_1$, $B_2$) provided on the exterior of a closed housing cooperate via the intermediary of an interpretation circuit with the electronic coding means (22) to drive the vibration generating device (23) by means of pulse strings to emit vibration strings representative of an item of time information or of the accuracy of a time instruction or non-time instruction introduced by means of said control elements.

The timepiece presents a conventional appearance, but enables a visually impaired person to know the time, to correct the internal time and to set an alarm time.

17 Claims, 5 Drawing Sheets

WATCH WITH TIME INFORMATION VIA SILENT VIBRATION

The instant invention relates to a timepiece providing time information by touch, in a silent manner. More particularly, it relates to a watch of conventional appearance which can be worn by a visually impaired person so as to permit him to know the current time and to have access to other conventional functions of a watch, such as the setting of an alarm time, without arousing the attention of a third party, or without having to seek assistance.

The instant invention consequently does not relate to substantially acoustic devices, such as vocal synthesis timepieces, the usefulness of which is incontestable for the visually impaired, but which has the disadvantage of clearly indicating the handicap of the user.

DESCRIPTION OF THE PRIOR ART

The most widely used watches for the visually impaired make use of an active sense of touch, such as the location of the hands in relation to indexes in relief positioned around the dial, the watch-glass constituting the cover being flipped to read the time. A watch of the preceding type corresponds, for example, to the device described in German utility models No. 7 435 930 and No. 8 700 364. In the latter case, the watch has a 24-hour movement, a twin inscription in Arab numerals and in Braille, and makes it possible to set an alarm time. In Japanese patent application No. 28 957/86, the hands are replaced by two sets of push-buttons for the twelve hourly positions making it possible to locate by touch the push-button of each series presenting a resistance at the positions which the hour hand and the minute hand would otherwise occupy.

Watches of this type clearly indicate that the user is visually impaired because of their overall esthetic appearance and the manipulations which they necessitate. Moreover, even if this is satisfactory for most daily needs, watches of this type only make it possible to tell the time to the nearest 5 minutes.

Based on the known principle of watches with a vibrator, notably watches termed silent alarm watches, such as the device described in Swiss patent 323 056, designers have considered coding vibrations to enable a visually impaired person to know the time by making use of his passive sense of touch, that is, without need for location. The device proposed in Swiss patent 618 827 has four vibrators distributed around the wrist at the positions 3, 6, 9 and 12 o'clock which makes it possible to know the time to the nearest 5 minutes by counting a reduced number of pulses. A watch of this type has an outer appearance which clearly distinguishes it from watches normally worn by sighted persons. U.S. Pat. No. 3,938,317 uses a single vibrator, in connection with a dot dash code making it possible to code the numbers from 1 to 12 and zero using strings having, at most, three dot dash vibrations. As disclosed, this device has the advantage of being able to give the time to the nearest minute, but has, on the other hand, the disadvantage that a complex code has to be learned. Moreover, although it is very detailed, the specification contains no instructions regarding the possibility of setting an alarm time.

OBJECTS OF THE INVENTION

The instant invention is directed at overcoming these disadvantages by providing a watch, the outer appearance of which makes it difficult or impossible to distinguish it from a conventional watch, but which enables a person having a visual handicap the possibility, not only to know the current time, but also, without consulting a third person, to have access to other customary functions, such as correction of the internal time, or setting an alarm time.

BRIEF SUMMARY OF THE INVENTION

For this purpose, the timepiece of the invention has a housing closed by a glass which protects a dial having a conventional time display in analog or digital form. The housing contains a traditional time-keeping circuit associated with an energy source and notably comprising an oscillator, a division chain and counters. The time-keeping circuit controls a conventional display and also delivers time signals to electronic means adapted to code in the form of pulses or pulse strings said signals, said electronic means that are also able to receive and code other non-time signals. The timepiece also comprises a device for generating silent vibrations, such as an electromagnetic micromotor integral with the back of the housing. Finally, it has control elements on the outside of the housing adapted to cooperate with the electronic coding means to drive the device for generating vibrations or vibration strings by means of pulse strings, either to deliver an item of time information, such as the current time or an alarm time, or to confirm the accuracy of location of a time value, a time command or a non-time command introduced using said control elements.

As will be seen hereinbelow, one of the essential features of the instant invention is that it confirms to a visually impaired person the correctness of the manipulation carried out on a control element, which is seen poorly or not at all. For this purpose, it is important that the vibration strings coding each manipulation and the vibration strings which code the current time are easily comprehensible. Numerous coding principles can be used, but the following detailed examples will propose codes having signals of different durations, the concatenation of which is designed according to a logic which simplifies learning and memorisation.

To simplify learning, another object of the invention is to make it possible to adapt the product to individual memory abilities by incorporating in the electronic coding means, means making it possible to vary the speed of emission of the vibration strings.

Similarly, to adapt the product to individual needs with regard to the desired degree of accuracy in indicating the current time, another feature of the invention ensures that the control element that has to be manipulated to know the time can be activated in two different modes to give the time to the nearest 5 minutes, or to the nearest 1 minute. It is, for example, possible to vary the duration of the pressure exerted on said control element and/or the number of pressures exerted thereon.

The vibration generating device can be a known device used in silent alarms, such as a vibrating piezo-electric element of the type described in European patent 0,349,230, or an electromagnetic motor of the type described in U.S. Pat. No. 5,365,497 (Swiss priority 01 512/93-5 incorporated).

Control elements that permit the introduction of time or non-time information can take the form of activatable tactile marks located on the bezel, on the glass and/or on the case band.

BRIEF DESCRIPTION OF THE INVENTION

According to a first embodiment, activatable marks are located on a fixed bezel which has facing each mark a position sensor, such as a capacitive, resistive or piezoelectric sensor, or simply an electric contactor, said sensors being sensitive to the position or to the pressure of a finger. Similarly, said sensors can be located on a crown of the glass close to the bezel.

According to a second embodiment, marks are located on a revolving bezel, said marks being activatable by causing them to rotate opposite a fixed mark. In this case, micromachined Reed relays may advantageously be used.

In this first and second embodiment, the selection of a mark is confirmed by the emission of a vibration string coding said mark, either by maintaining the selection for a determined period, or by exerting pressure on another control element, such as a push button located on the case band.

The marks located on the fixed or rotating bezel can be divided into two areas corresponding, respectively, to numerical marks and to marks of modes of operation. To make it possible to modify the time values of the watch, numerical marks can have 10 or 12 positions representing the numbers from 1 to 9 and zero, or the numbers 1 to 12, depending on the code used for the vibration strings. The area having marks for the modes of operation can, for example, make it possible to change the speed of transmission of the vibrations, to activate or deactivate the alarm function, or to call up an item of time information other than the time, such as a calendar function.

According to a third embodiment, the control elements are only composed of the crown and of push-buttons located on the case band. One of these push-buttons is reserved for inputting numerical data by simple counting, either of the number of pressures exerted, or of the number of simple, non-coded vibrations, counted up to the desired number by maintaining pressure on said push-button.

BRIEF DESCRIPTION OF THE DRAWINGS

Other features and advantages of the invention will emerge more clearly from study of the following detailed description, given with reference to the appended drawings which are given here by way of example, and in which.

DETAILED DESCRIPTION OF THE INVENTION

Figure 1:
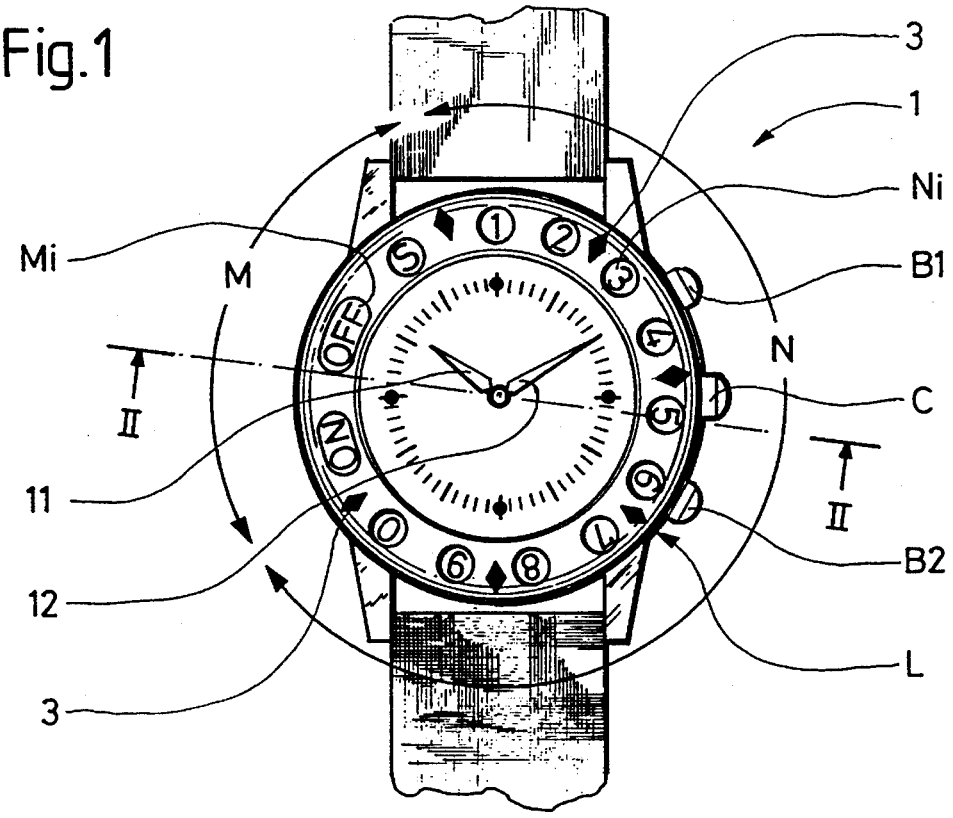
FIG. 1 shows a view from above of a first embodiment of a watch according to the invention in which marks are located on a fixed bezel.
Figure 2:
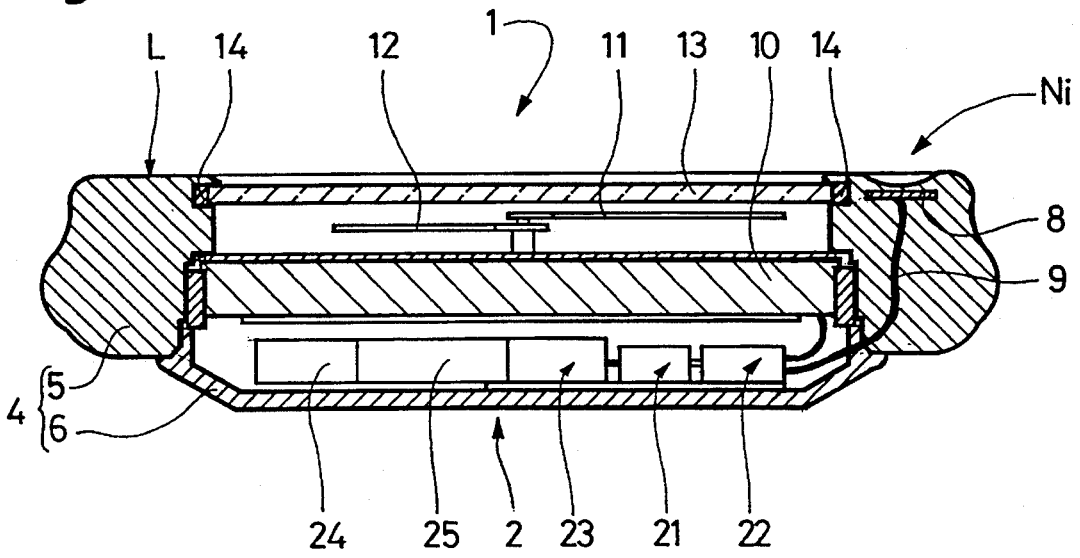
FIG. 2 shows a section along the line II—II of FIG. 1.

Reference being made more particularly to FIGS. 1 and 2, a timepiece will first be briefly described, designated by the general reference 1, provided with a module having the silent vibration generating device, designated by the general reference 2. The timepiece has a housing 4, composed of a case band 5 and a back 6 fixed in conventional manner to the case band. The case band has a fixed bezel L provided with a first sector N with marks Ni corresponding to numerical values, and a second sector M with marks Mi corresponding to modes of operation.

As shown in FIG. 2, each mark Ni or Mi is shaped like a depression so that it can be located by touch by a visually impaired person. In place of depressions, it may easily be imagined that location could be facilitated by projections or by any other means combining, for example, depressions and projections. The example shown also has depressions Ni and Mi and projections 3 to separate the sector M from the sector N, and also to regroup the zones Ni in twos, to facilitate location still further.

The marks Ni correspond to the numbers from 1 to 9 and zero, the number 1 being positioned at 12 o'clock. The marks Mi correspond to the modes of operation "ON", "OFF" and "S" which will be explained in greater detail hereinbelow. Opposite each mark Ni or Mi is a sensor 8, connected by a conductor 9 to the module 2. The sensors used are of the capacitive type, well known to the person skilled in the art, and it is not necessary to describe them in more detail here. The timepiece 1 has a movement 10 which is mounted in the case band 5 and which is adapted to drive the hour hand 11 and the minute hand 12 in conventional manner. Similarly, as will be seen in the other embodiments described hereinbelow, the movement 10 can also be associated with a digital display.

The housing 4 is closed on the side opposite the back 6 by a glass 13, engaged in the case band 5 with interpolation of a sealing ring 14. As may be seen, the glass cannot be tilted in any way to give access to the dial, thereby guaranteeing its tightness.

The case band also has a crown C capable of driving a shaft in translation or rotation according to a slow or rapid mode, corresponding to several different commands, as is for example described in European patent 0 175 961. The case band also has two push-buttons B1 and B2, each also being able to correspond to several different commands depending on how long pressure is maintained, or according to the number of pressures exerted.

The module 2 comprises an energy source 21, electronic coding means 22 and a vibratory device 23. The energy source 21 can be that which is also needed for the movement. In the example described, the vibratory device 23 comprises a motor of the electromagnetic type capable of transmitting an oscillatory movement to a weight 24 via the intermediary of a resilient connecting element 25, said oscillatory movement being transmitted to the cover 6 to be perceived in the form of vibrations on the wrist of the user. Depending on the features of the electromagnetic motor and of the materials constituting the exterior of the watch, these vibrations could also be perceived by touching any point of the watch with the finger, such as a point on the glass or the bezel, or a button B1 or B2.

Figure 3:
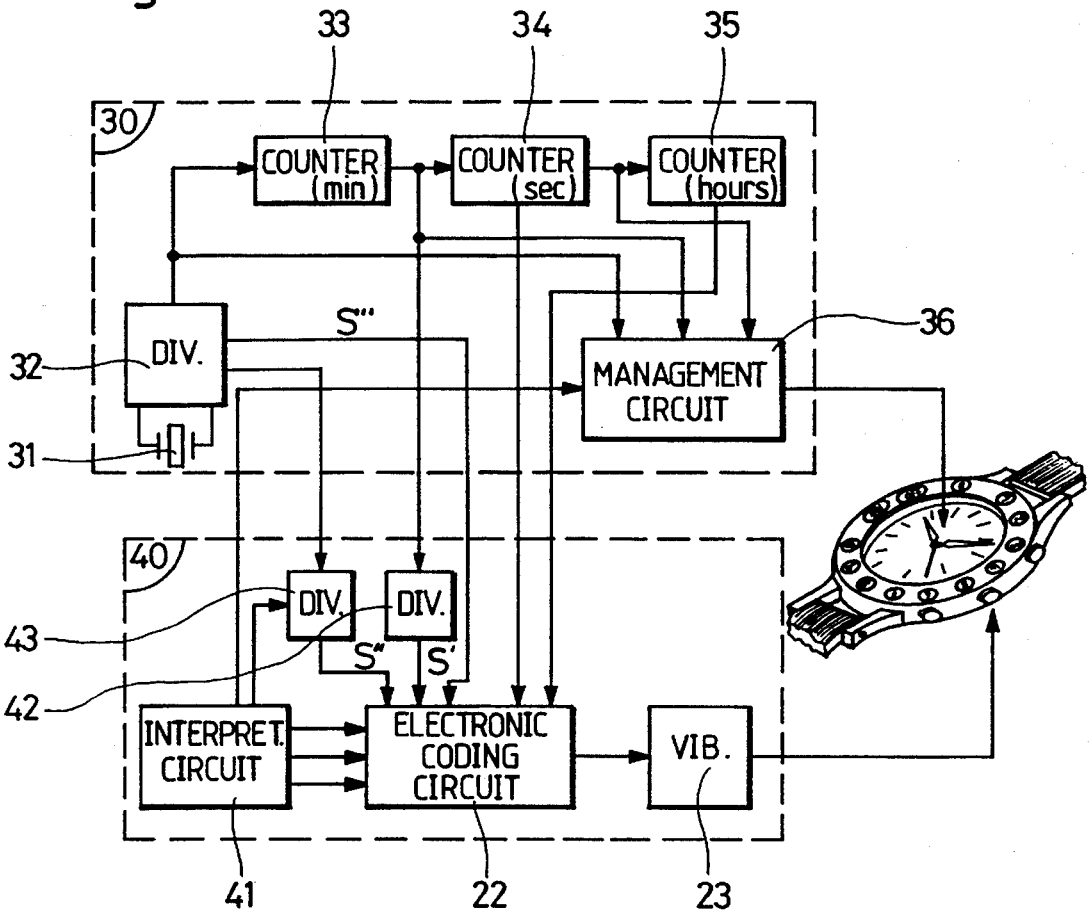
FIG. 3 shows the circuit of an embodiment of a watch according to the invention in the form of a block diagram.

FIG. 3 shows in the form of a block diagram the circuit of one embodiment of a watch according to the invention. It has a conventional time-keeping part designated by the reference numeral 30 and a part 40 adapted to produce silent coded vibrations.

The time-keeping circuit 30 essentially has a quartz oscillator having the base frequency 32786 Hz and its maintenance circuit 31, a division chain 32 delivering at its output a signal of 1 Hz frequency, a second counter 33, a minute counter 34 and an hour counter 35. It is clear that other counters could be added if one wished to give the timepiece a calendar function. The counters 33, 34 and 35 are counters by sixty, the mode of operation of which is shown diagrammatically in FIG. 4.

Figure 4:
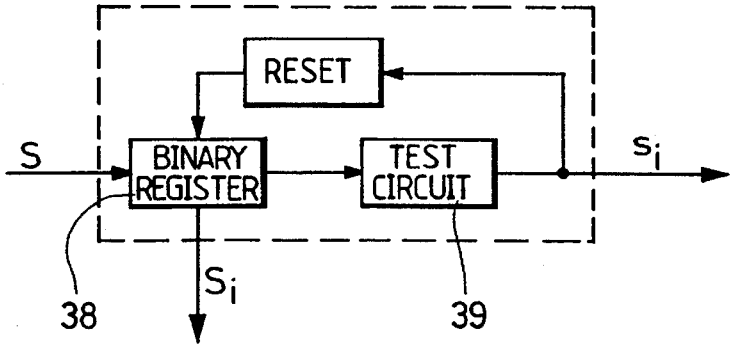
FIG. 4 shows an operating diagram of a counter such as those incorporated in the diagram of FIG. 3.

As may be seen in FIG. 4, successive pulses of a signal S are counted by a binary register 38 of at least six bits, which they increase by increments. The state of this register can be read at any moment (signal Si). At each increment, the register 38 is tested in a circuit 39 composed of a divider by sixty. When the number which it contains is equal to sixty, a signal $s_i$ is emitted on the one hand to zero the register 38 (RESET), on the other hand to constitute the input signal from another counter.

Reference being made once again to FIG. 3, it will be seen that the signals $s_i$ emitted by each counter are used by a management circuit 36 intended to display the time in conventional manner.

As regards the signals $S_i$, they are used in the part 40 where they are received by the electronic coding means 22, which also receive signals S', S" and S"'. The signal S' is emitted by a divider by twelve 42 in response to a minute signal at the output of the counter 33. As will be seen hereinbelow, this signal will notably be useful for a mode of coding that is able to give the time to the nearest minute.

The signal S" is emitted by a binary division chain 43 in response to a signal extracted from the division chain 32 and chosen at a frequency greater than 1 Hz. This signal S" constitutes the clock signal which will make it possibly to vary the emission speed of the vibration strings. Its useful frequency can be adjusted by means of a signal received from a circuit 41 for interpreting the manipulations effected on the exterior control elements B1, B2, C or L, said circuit 41 also emitting other signals representative of the functions selected apart from the vibration emission speed towards the electronic coding means 22. The interpretation circuit 41 can also control the management circuit 36.

For better comprehension, the divider by twelve 42 and the binary division chain 43 have been shown on the block diagram of FIG. 3, separate from the electronic coding means 22, but the person skilled in the art will easily understand that these elements can be integrated in a single programmed microprocessor. The same could apply to the management circuit 36 for the customary display of the time. The signal emitted by the electronic coding means 22 finally controls the emission of silent vibration strings by the vibrating device 23. The frequency of these silent vibrations is determined by a signal S"' extracted from the division chain 32. Given a base frequency of 32768 Hz for the resonator, the signal S"' could, for example, be given a frequency of 128 Hz.

It has been presumed in the foregoing that the time information delivered is the current time or the alarm time installed, but by adding other counters in series with the counters 33, 34, 35 it is also possible to know the day of the week and the month with pulse strings coded like the hours, and to know the day of the month with pulse strings coded like the minutes, when a coding to the nearest minute is used.

The electronic coding means 22 can advantageously be realised in the form of a programmed microprocessor. From the preceding information and the examples hereinafter the person skilled in the art will be able to program the microprocessor in such a way as to cause it to execute the appropriate codes.

Reference being made to FIGS. 1 and 5 to 9, 5 examples illustrating various embodiments of the invention will now be described.

EXAMPLE 1

A brief description will now be given of an analog display timepiece with reference to FIGS. 1 and 5 in which the exterior control-elements are formed on the one hand by a fixed bezel having numbered marks 1 to 9 and zero and three functional marks "ON", "OFF" and "S", on the other hand by a crown C and two buttons $B_1$ and $B_2$ located on the case band and serving as push-buttons.

So as to "read" the current time, pressure is applied to the crown C to obtain the emission of the vibration strings coding the time. Depending on the arrangement of the interpretation circuit 41 and the programming of the microprocessor 22 it is possible to "read" the time by the 12 hour-clock, for example by pressing once, or to read the time by the 24 hour-clock, for example by pressing a second time.

Depending on how long pressure is maintained—for a short or long time—it is possible to know the time to the nearest five minutes or to the nearest minute.

After appropriate manipulation on the crown C, the time is provided in the form of vibration strings according to a coding proposed to facilitate memorisation and consequently to simplify construction of the timepiece.

Figure 5:
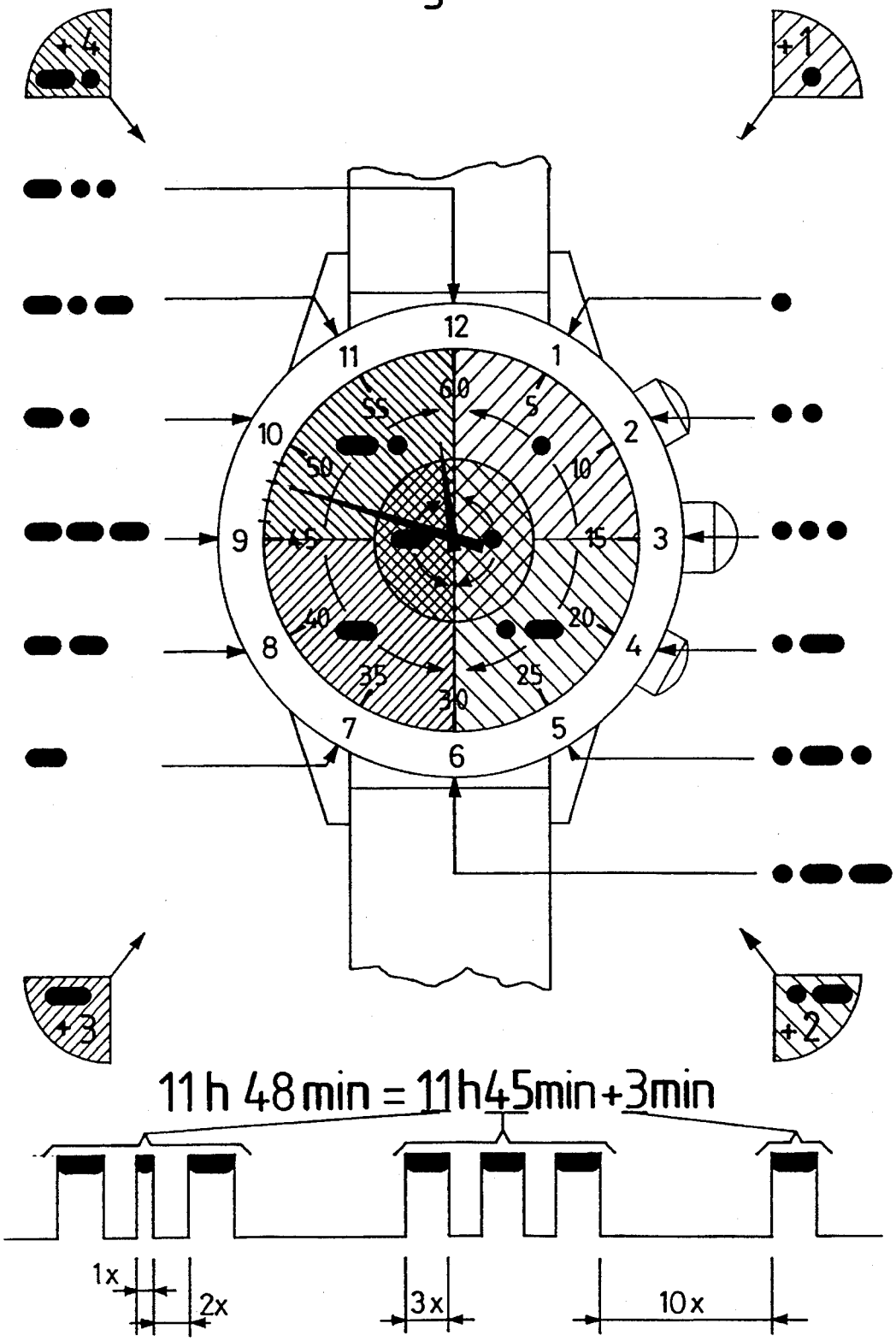
FIG. 5 shows a dot dash code of the twelve hour positions.

Referring now to FIG. 5, it will be seen that the numbers 1 to 12 are coded in a function of their position logic around the dial, said logic already being familiar to a visually impaired person from watches having an opening glass necessitating location by touch. This code is of the dot-dash type and each pulse string has no more than three signals. For the numbers from the first and second quadrant, priority is given to the short pulses, with the result that all the numbers from 1 to 6 begin with a short pulse and that a long pulse is only used when the progression towards a rising value permits no other choice. Inversely, in the third and fourth quadrant, priority is given to the long pulses, with the result that all the numbers from 7 to 12 begin with a long pulse and that a short pulse is only used when the progression towards a rising value permits no other choice. The numbers from 1 to 12 coded in this way make it possible to deliver a first pulse string representing the hour and a second pulse string representing the minutes to the nearest five minutes, that is values that are multiples of 5.

As a result of this coding, each group of three numbers contained in each quadrant has the same initial signals, said signals being used to code the values from 1 to 4, needing to be added to the whole values that are multiples of 5 in order to achieve accuracy to the nearest minute. The pulse string coding 12 hours, 24 hours and 60 minutes also codes zero.

It will also be noted that the dot-dash codes of diametrically opposed numbers are complementary, which also facilitates memorisation. Two complementary codes are free to make it possible to deliver the time on the 24-hour clock by coding AM and PM. FIG. 5 can therefore also be represented in the form of the following table:

| hour/minutes | hour/minutes |
|---|---|
| 1/5 . | 7/35 - |
| 2/10 .. | 8/40 -- |
| 3/15 ... | 9/45 --- |
| 4/20 .- | 10/50 -. |
| 5/25 .-. | 11/55 -.- |
| 6/30 .-- | 12/zero -.. |

Beginning of coding 1st quadrant, or value +1: -
Beginning of coding 2nd quadrant, or value +2: .-

-continued

| hour/minutes | hour/minutes |
|---|---|
| Beginning of coding 3rd quadrant, or value +3: - | |
| Beginning of coding 4th quadrant, or value +4: -. | |
| AM: ..- | PM: --. |

FIG. 5 shows an example of the coding by 12 hours to the nearest minute. In addition, the coding of four different times in 24 hours is shown hereinbelow, the coding AM or PM being placed at the beginning.

| |
|---|
| 0 h 42 mn: ..-/-../--/.- |
| 21 h 03 mn: --./---/-../- (21 h + 00 mn + 3 mn) |
| 21 h 35 mn: --./---/- |
| 9 h 01 mn: ..-/---/-../. |

The respective durations of one short vibration, one space between two vibrations, one long vibration and one space between two vibration strings are advantageously multiples of the duration separating two pulses of the signal S". Always assuming a resonator having a frequency of 32768 Hz, the above-mentioned durations could, for example, assume the values 125 ms, 250 ms, 500 ms and 1250 ms. By acting on the frequency of the signal S" by the intermediary of the divider 32 it would be possible to vary these durations proportionally so that the speed of emission of the pulse strings could be adapted to the perceptive abilities of each user.

To correct the internal time, it is first proposed to exert a long pressure on B1, for example for more than 2 seconds, then to introduce the desired time for more than 2 seconds, then to introduce the desired time in the form h.h./mn.mn. by exerting successive pressures on the numerical marks of the crown, each pressure bringing about the emission of a confirming vibration. The accuracy of the correction effected can be checked by exerting pressure on C, immediately after the correction. In the case of an analog type display, correction of the internal time does not generally modify the position of the hands 11, 12 and this correction has to be effected by turning the shaft, which is the only operation requiring the intervention of a third party who is not visually impaired.

According to a comparable process, it is possible to program an alarm time after having exerted long pressure on $B_2$. Once the alarm time has been programmed, it is activated by exerting pressure on the ON key. Brief pressure on $B_2$ delivers a vibration string coding the alarm time set by way of confirmation. This manoeuvre can be effected at any time to check whether or not the alarm has been activated. Conversely, exertion of pressure on the OFF mark deactivates the alarm, which can be controlled by exerting brief pressure on $B_2$, which should then provoke no vibration.

In FIG. 1, the letter "S" shows a different function key for selecting the speed of emission of the vibrations. After having exerted pressure on "S", pressure is exerted on a number chosen between 1 and 9. To check the suitability of the selected speed, it is possible either to read the current time by exerting pressure on the crown C, or by exerting brief pressure on $B_1$ which, according to the speed selected, could then deliver vibration strings programmed at the moment of construction, such as the vibration strings which code each quadrant, by constructing some form of method for recalling the general coding.

As has been indicated at the outset, the location by touch of the different active zones of the bezel is facilitated by a depression-shaped design. This location can be simplified still further by giving the depressions different shapes according to their allocation, numerical or functional, or by separating the two respective zones by projections 3 and/or by also adding projections 3 between the numerical marks, for example every second number.

EXAMPLE 2

Figure 6:
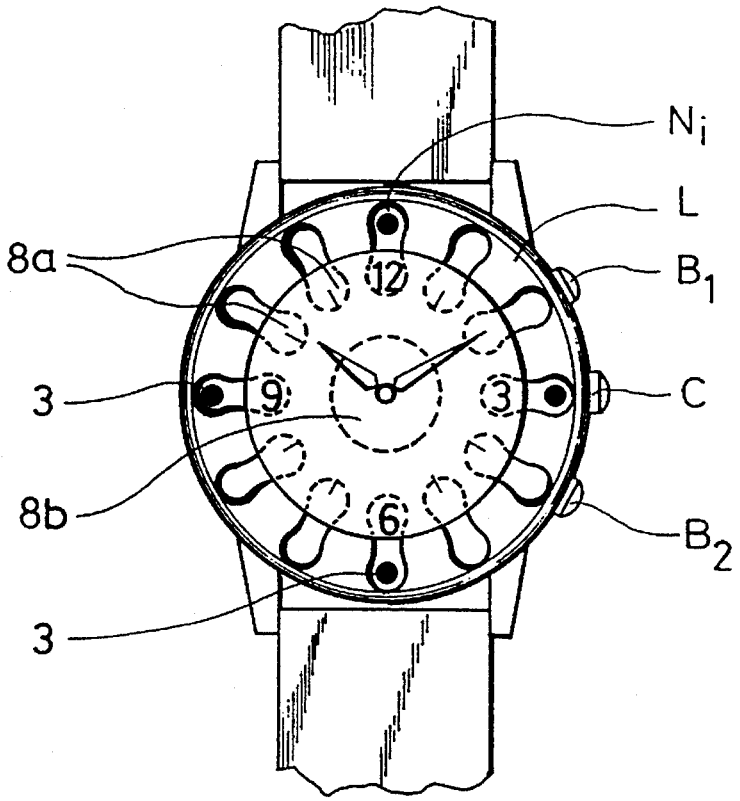
FIG. 6 is a diagrammatic representation of a first variant of the first embodiment shown in FIG. 1.

According to a first variant of the embodiment of example 1, FIG. 6 shows diagrammatically a watch having twelve marks Ni corresponding to the twelve hourly positions on a fixed bezel, said marks being opposite capacitative sensors 8*a* located on the glass. The positions 3, 6, 9 and 12 h also have a projection to facilitate location. According to this variant, "reading" the time is effected both by locating the hour positions by touch and by the emission of vibration strings according to a simplified coding, as indicated hereinafter.

To read the time, pressure is first applied to the crown C to initialise this function without this triggering the emission of vibrations. The circumference of the glass is then lightly touched on the sensors 8*a*, until a vibration, or until several vibrations representative of the position of a hand, or of that of the two hands is sensed, and then the time position is intensified by the corresponding mark Ni and the vibrations emitted are decoded. The microprocessor 22 is also programmed to execute a coding by means of three types of vibrations having durations that cannot be confused, namely:

- a long vibration for the hours, lasting, for example, 2 seconds;
- a short vibration for the minutes, lasting, for example, 0.5 seconds, and
- a string of very short vibrations, for example five vibrations each lasting 0.1 second for the value zero or for a whole hour.

For a current time, for example 11h48, two locations are necessary. When the user follows the circumference of the glass with his finger, he will first identify the position 11*h* by perceiving the long vibrations as long as he keeps his finger on this position. By following the circumference of the glass a second time, he will sense on the position 9*h*, that is 45 minutes, strings composed of as many short vibrations as it is necessary to add units to the whole value that is a multiple of five already identified to know the time to the nearest minute, namely in this example, strings composed of three short vibrations. If the number of minutes is a whole multiple of five, for example 11h45, the short vibrations are replaced by very short vibrations coding the value zero.

Two categories of time situations make it possible to know the time using a single location.

For a whole hour, for example 18h00, the vibrations emitted for the position located are composed of the succession of very short vibrations.

For a time in which the two hands occupy the same time position, for example 6h32, the vibrations emitted for the position located are composed of the succession of one long vibration and of a string composed of as many short vibrations as one needs to add units to the whole value which is a multiple of five, already identified to know the time to the nearest minute, more specifically in this example strings composed of a long vibration and two short vibrations. As previously, when the number of minutes corresponds to a whole multiple of five, the short vibrations are replaced by very short vibrations coding zero.

It follows that training and memorisation are limited to recognising by touch the twelve hourly positions, to identify vibrations of three different durations and to being able to count up to four.

To correct the internal time, pressure is exerted for a long time on B1 and then the desired time is felt by touch on the bezel and the finger is moved to the corresponding sensor 8*a*. This action is repeated to set the minutes to the nearest five minutes, and then a sensor 8*b* located at the centre is activated the requisite number of times to correct the internal time to the nearest minute. To validate this selection, pressure is briefly applied to B1 if it is before noon (AM) or pressure is applied twice briefly, if it is after noon (PM).

An alarm time is programmed in similar manner after having first exerted long pressure on B2. Activation of the alarm is effected by exerting brief pressure on B2 and deactivation is effected by pressing briefly once more. To adjust the speed of emission of the vibrations, the interpretation circuit 41 is adapted to initialise this function when the shaft is pulled using the crown C, the speed then being selected using the marks 1 to 12 of the crown, the selection effected also being validated by brief pressure on B1. This arrangement is particularly useful to avoid incorrect manoeuvres, bearing in mind the fact that, for a given user, this setting, once effected, would no longer need to be modified.

EXAMPLE 3

Figure 7:
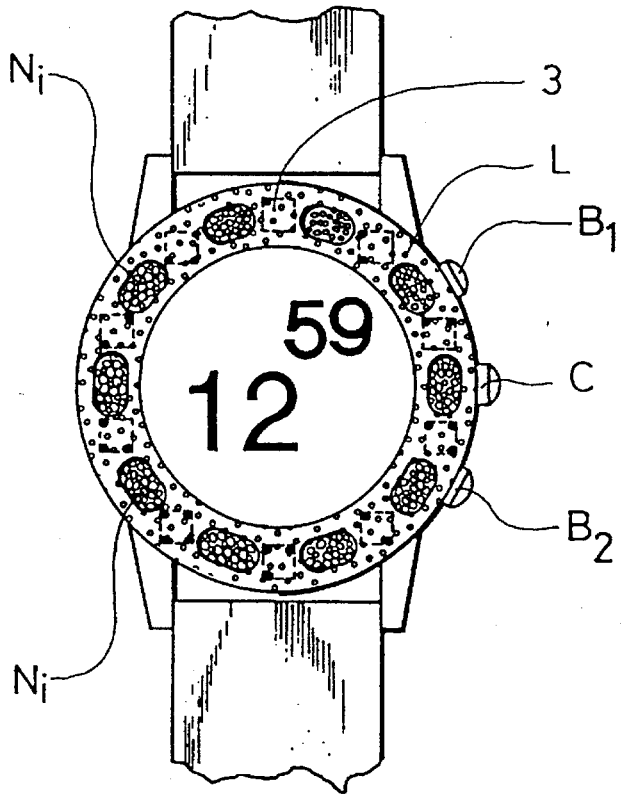
FIG. 7 is a diagrammatic representation of a second variant of the first embodiment shown in FIG. 1.

According to a second variant of the embodiment of Example 1, FIG. 7 shows in diagrammatic form a watch, the fixed bezel of which has ten numerical marks preceded by projections corresponding to the writing in Braille of the numbers from 1 to 9 and of zero. To achieve one of the objects of the invention, namely to conceal the fact that the user is visually impaired, the Braille coding of each number, written in the corners of a square, is masked by a pebble-textured decoration applied to the entire surface of the bezel, the difference appearing on FIG. 7 being deliberately exaggerated to simplify comprehension. "Reading" the time is effected as indicated in Example 1, by means of coded vibration strings emitted after pressure has been exerted on the crown C.

In the watch shown, the conventional display is of the digital type, so that a visually impaired person can correct the time displayed themselves by correcting the internal time as already described, after having pressed $B_1$ for a long time. Similarly, to set the alarm, $B_2$ is pressed for a long time and then the desired time is programmed by exerting successive pressures on each marked zone by touch on the Braille coding. Once the alarm time is set, the alarm is activated by brief pressure on $B_2$, and is deactivated by a second brief pressure.

As described above, each manoeuvre is confirmed by the emission of a vibration string, or, on the contrary, by the absence thereof. To set the speed of emission of the vibration strings, the push-button $B_1$ can be used by exerting brief successive pressures, which make it possible to access a loop on which determined speeds have been programmed into the electronic coding means.

EXAMPLE 4

Figure 8:
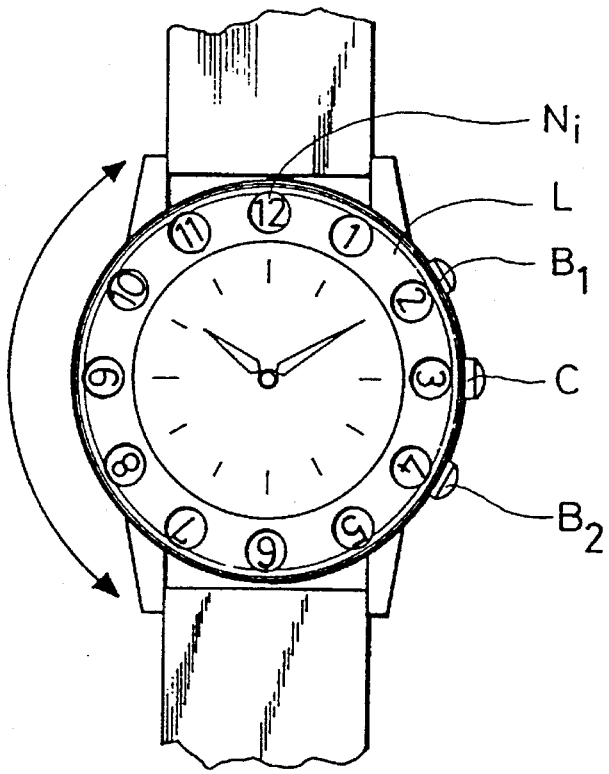
FIG. 8 is a diagrammatic representation of a second embodiment of a watch according to the invention in which the marks are located on a mobile bezel.

According to a second embodiment shown diagrammatically in FIG. 8, a watch according to the invention has a revolving bezel provided with twelve marks corresponding to the twelve hour positions. Reading the time is effected as indicated in Example 1, after pressing the crown C. This revolving bezel permits the selective activation of twelve contacts located on the ring of the case band opposite the bezel, when one of the marks Ni is moved by rotating the bezel opposite a fixed mark of the case band, such as the button $B_1$ . The selection is validated by exerting brief pressure on $B_1$ if one is in the time sector before noon (AM) and by exerting brief pressure twice if one is in the time sector after noon (PM).

The contactors which permit selection may advantageously be composed of micromachined Reed relays, the magnet permitting their activation then being buried in the material composing the bezel. As previously indicated, location of these twelve positions is made possible by shaping them like a depression or a projection, providing moreover for automatic return to a neutral position as indicated on FIG. 8, after each selection.

According to a variant, it can be arranged that any angular displacement of one step corresponding to a mark causes the emission of a vibration which the user could count, until its validation by brief pressure on $B_1$, said pressure at the same time zeroing the counting.

It follows that in this second embodiment, correction of the internal time can be effected by exerting long pressure on $B_1$, then by selection through rotation of the bezel and by validation by one or two brief pressures on $B_1$ two numbers between 1 and 12 making it possible to obtain accuracy to the nearest five minutes. This can be repeated to program an alarm time by having first exerted long pressure on $B_2$. Activation and deactivation of the alarm could be effected as previously indicated by exerting brief pressures on $B_2$.

Adjusting the speed of emission of the vibrations can be effected as indicated in Example 2.

EXAMPLE 5

Figure 9:
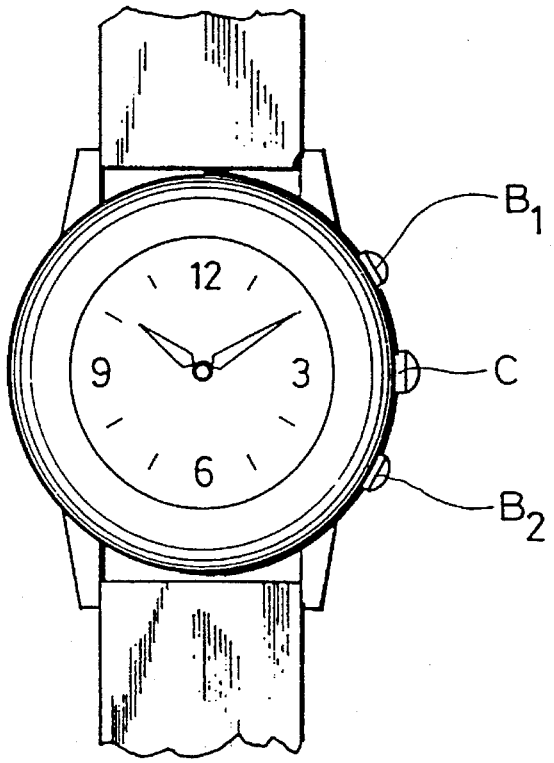
FIG. 9 is a diagrammatic representation of a third embodiment in which no mark at all is located on the bezel.

According to a third embodiment shown diagrammatically in FIG. 9, the control elements are solely composed of the crown C and the buttons $B_1$ and $B_2$ having push-button function.

Pressure on the crown C makes it possible to read the time as shown in Example 1.

To correct the internal time, brief pressure is first exerted on $B_1$ and then by exerting pressure a second time and by maintaining this, the number of vibrations emitted are counted four times until the desired values to obtain the time to the nearest minute in the form h.h/mn.mn.

Similarly, to adjust the alarm time, long pressure is first applied to $B_2$ and a count is effected as previously indicated using the button $B_1$. Activation and deactivation can be effected as previously indicated using the button B1. Activation and deactivation can be effected as indicated in Examples to 2 to 4 above by brief successive pressures on $B_2$.

To adjust the speed of transmission of the vibration strings, the interpretation circuit 41 is adapted to initialise this function when the shaft is pulled using the crown, the speed then being selected by exerting long pressure on $B_2$ to access a loop containing predetermined speeds.

According to the general principle of the invention, a vibration or vibration string serves as a means of checking the accuracy of the manipulation effected. In this third embodiment, the vibrating element 23 can also be connected to the button $B_1$ to deliver vibrations, not only to the wrist via the intermediary of the housing, but also to the finger exerting the pressure.

In the preceding examples, the same elements $B_1$, $B_2$ and C fulfil substantially the same functions, solely in order to ensure better comprehension, but it follows that the person skilled in the art is able, by appropriate arrangement of the interpretation circuit, to cause them to fulfil functions other than those which have just been described.

Similarly, whereas the entire description of the instant invention has substantially been made with reference to a person suffering from a visual handicap, it follows that this same timepiece can also prove very useful to a sighted person in certain situations where it is not possible to consult the time in a visual manner.

What is claimed is:

1. An electronic timepiece adapted to deliver time information in silent tactile manner and comprising:

a housing closed by a glass;

a time-keeping circuit associated with an analog or digital display, notably comprising an oscillator and its maintenance circuit, a division chain and counters;

control elements provided on the outside of said housing, selected from amongst a bezel (L) provided with numerical tactile marks (Ni) or functional marks (Mi) opposite sensors and a crown and buttons with push-button function (C, $B_1$, $B_2$), an interpretation circuit of the displacements of said control elements (L, C, $B_1$, $B_2$), electronic coding means adapted to code time signals received from said time-keeping circuit and/or non-time signals received from said interpretation circuit in the form of pulse strings, and a device generating silent vibrations, wherein, in said timepiece, said control elements (L, C, $B_1$, $B_2$) cooperate via the intermediary of said interpretation circuit with said electronic coding means to drive the vibration generating device by means of pulse trains so as to emit vibration pulses representative of time information or of the accuracy of a time instruction or non-time instruction introduced by means of said control elements.

2. A timepiece according to claim 1 wherein the control elements cooperating with electronic coding means to deliver a time information are formed at least by one push-button, (C, $B_1$, $B_2$), the activation of which enables the vibration generating device to emit a vibration string representative of said time information in a single action.

3. A timepiece according to claim 1 wherein the control elements cooperating with the electronic coding means to deliver an item of time information are composed of one or two numerical keys (Ni) the activation of which by pressure or positioning of a finger enables the vibration generator devised to emit one or two vibration strings representative of said time information.

4. A timepiece according to claim 1 wherein the push-button control elements are provided with several activation modes recognisable by the interpretation circuit to make it possible to deliver various items of time information or to execute various time instructions or non-time instructions.

5. A timepiece according to claim 1 wherein the electronic coding means also have means to vary the speed of emission of the pulse strings.

6. A timepiece according to claim 1 wherein the vibration generating device is of the electromagnetic type and is entirely contained in the housing.

7. A timepiece according to claim 1 wherein a control element making it possible to introduce time information or non-time information is composed of a bezel (L) outside the housing and provided with tactile activatable marks ($N_i$, $M_i$).

8. A timepiece according to claim 7 wherein the bezel (L) is a fixed bezel and each mark is opposite a position sensor activatable by pressure or positioning of a finger.

9. A timepiece according to claim 7 wherein the bezel (L) is a revolving bezel each mark can be activated by causing it to coincide with another fixed tactile mark.

10. A timepiece according to claim 7 wherein confirmation of the selection of a mark is effected by the emission of an associated vibration string, either in automatic manner, or by pressure on a control element.

11. A timepiece according to claim 7 wherein the bezel has an area having 10 or 12 positions corresponding to numerical marks ($N_i$) making it possible to correct the internal time or to set an alarm time, and an area corresponding to marks of the mode of operation ($M_i$) that can be selected to obtain a change in the speed of transmission of vibrations, the activation or deactivation of an alarm function or the call-up of a calendar function.

12. A timepiece according to claim 1 wherein the control elements making it possible to introduce time information or non-time information are solely composed of a crown and push-buttons (C, $B_1$, $B_2$).

13. A timepiece according to claim 12 wherein one of the push-buttons ($B_1$, $B_2$) is adapted to permit the introduction of a time information by simple counting of the vibrations up to a desired number by maintaining pressure with one finger.

14. A timepiece according to claim 2 wherein the electronic coding means are composed of a microprocessor programmed so as to code the twelve hour positions of an analog display in the form of pulse strings comprising at most three short or long pulses, according to a logical progression giving priority to the selection of short pulses for the numbers from 1 to 6 of a first and of a second quadrant, and priority to the selection of long pulses for the FIGS. 7 to 12 of a third and fourth quadrant of said display.

15. A timepiece according to claim 14 wherein the sequences of pulses common to the figures of each quadrant code the pulse strings representative of the values from 1 to 4 which must be added to a time information given to the nearest 5 minutes by the twelve hour positions to obtain an accuracy to the nearest minute.

16. A timepiece according to claim 3 wherein the numerical keys (Ni) are positioned on the twelve hourly positions of the analog display and the electronic coding means are composed of a microprocessor programmed so as to emit one or several long pulses when the activated numerical key (Ni) corresponds to the hour, short pulse strings when said key corresponds to the minutes, each string having 1 to 4 pulses depending on the value to be added to the immediately lower number of minutes being a multiple of five corresponding to the numerical key (Ni) activated, and very short pulse strings when said key corresponds to the value zero or a whole hour.

17. A timepiece according to claim 16 wherein the long pulses for the hours and the strings of short pulses for the minutes commence when the hour hand and the minute hand depend on a single numerical mark (Ni).

* * * * *